US005279133A

United States Patent [19]

Plath

[11] Patent Number: 5,279,133

[45] Date of Patent: Jan. 18, 1994

[54] CIRCULAR KNITTING MACHINE FOR MAKING PLUSH FABRIC

[75] Inventor: Ernst-Dieter Plath, Albstadt, Fed. Rep. of Germany

[73] Assignee: SIPRA Patententwicklungs-und Beteiligungsgesellschaft mbH, Albstadt, Fed. Rep. of Germany

[21] Appl. No.: 936,754

[22] Filed: Aug. 27, 1992

[30] Foreign Application Priority Data

Sep. 7, 1991 [DE] Fed. Rep. of Germany ..... 4129845

[51] Int. Cl.[5] ..... D04B 9/12

[52] U.S. Cl. ..... 66/9 R; 66/54; 66/104

[58] Field of Search ....66/8, 9 R, 20, 27, 38, 54, 57, 91, 42 R, 223, 216, 104

[56] References Cited

U.S. PATENT DOCUMENTS

| | | | |
|---|---|---|---|
| 2,756,574 | 7/1956 | Shortland | 66/20 |
| 3,209,557 | 10/1965 | Lagerweij | 66/54 |
| 3,882,694 | 5/1975 | Stepanek et al. | 66/54 |
| 4,307,586 | 12/1981 | Schmidt | 66/54 X |
| 4,589,266 | 5/1986 | Oakley, Jr. et al. | 66/133 X |

FOREIGN PATENT DOCUMENTS

| | | |
|---|---|---|
| 0335618 | 10/1989 | European Pat. Off. . |
| 0387094 | 9/1990 | European Pat. Off. . |
| 0295703 | 2/1991 | European Pat. Off. . |
| 1250587 | 9/1967 | Fed. Rep. of Germany . |
| 2355265 | 6/1974 | Fed. Rep. of Germany . |
| 2824314 | 12/1978 | Fed. Rep. of Germany . |
| 3035582 | 4/1982 | Fed. Rep. of Germany . |
| 3145307 | 6/1983 | Fed. Rep. of Germany . |
| 3035582 | 12/1983 | Fed. Rep. of Germany . |
| 1175217 | 12/1969 | United Kingdom . |

OTHER PUBLICATIONS

Ho-Lin Wang, "Knitting Engineering", 1975, pp. 51-52.

Min-Tai Wang, "Knitting Engineering", 1975, pp. 152-153.

*Primary Examiner*—Clifford D. Crowder
*Assistant Examiner*—John J. Calvert
*Attorney, Agent, or Firm*—Michael J. Striker

[57] ABSTRACT

The invention concerns a circular knitting machine for making plush fabric. The circular knitting machine has a needle cylinder fitted with knitting needles, a sinker ring fitted with sinkers, wherein the sinkers have edges adapted to handle a ground yarn and a plush yarn, and at least one knitting system. For independent adjustment to the stitch size and the plush yarn loops, a cylinder cam section has an adjustable cam part which serves to adjust the length of the plush yarn loops. A cam part independent therefrom and also adjustable serves to adjust the stitch size. This cam part can be arranged either in the sinker cam or the cylinder cam.

15 Claims, 9 Drawing Sheets

CIRCULAR KNITTING MACHINE FOR MAKING PLUSH FABRIC

BACKGROUND OF THE INVENTION (1) Field of the Invention

This invention concerns a circular knitting machine of the kind including a first support knitting implements for making stitches, a second support with implements for making loops, which have elements for handling a ground yarn and a plush yarn, and at least one knitting system which includes a cam part section for control of the knitting implements, a cam part section for control of the loop forming implements, at least one yarn feeder for feeding the ground yarn and at least one yarn feeder for feeding the plush yarn and in which system stitches consisting of the ground yarn and the plush yarn can be formed and loops formed solely from the plush yarn can be formed.

The invention also relates to a sinker with a nose extending in a longitudinal direction and forming with an edge spaced from the underside of the sinker a longitudinal slot likewise extending in the longitudinal direction and forming with its upper edge an middle edge which is spaced from an upper edge of the sinker.

(2) Description of the Prior Art

In circular knitting machines of this kind there is frequently the need to preselect independently the size on the one hand of the stitches formed from the ground and plush yarns and on the other hand of the bows or loops formed from the plush yarn alone, in order to match the kinds of yarn used (thick, thin, crimped yarn, etc.) For this it is known (DE-PS 3 035 562) to associate with the knitting needles two-part sinkers mounted slidably in a sinker ring and to use the magnitude of the advance movement of the one sinker part to adjust the length of the plush yarn loop or bow and the magnitude of the advance movement of the other sinker part to adjust the stitch size. Similar possibilities arise in the use of circular knitting machines with dials, in which special hooks are mounted slidably (DE-AS 1 250 587), which are controlled by adjustable cam parts and serve for the selective adjustment of the lengths of the plush bows or stitches.

The use of two-part sinkers has the disadvantage that with high degrees of gauge or fineness (number of needles per inch) mechanical problems arise and the friction between the two sinker parts is appreciable. If however one-piece sinkers are used to avoid this disadvantage (DE-PS 2 824 314), it is not then possible to adjust the size of the stitches and the plush yarn loops independently of one another.

SUMMARY OF THE INVENTION

The invention is therefore based on the problem of developing the circular knitting machine of the kind initially set forth in such a way that the sizes of the stitches and the lengths of the plush yarn loops are independently adjustable, in spite of the use of one-piece sinkers. The object of the invention is moreover to provide a sinker suitable for such a circular knitting machine.

The circular knitting machine for making plush fabric according to the invention comprises a first support with knitting implements for making stitches; a second support with loop forming implements for making loops, the second support having means for handling a ground yarn and a plush yarn; and at least one knitting system for forming stitches having a size and consisting of the ground yarn and the plush yarn and for forming loops having a length and formed solely from the plush yarn; wherein the at least one knitting system includes at least one yarn feeder for feeding the ground yarn; at least one yarn feeder for feeding the plush yarn; first cam means for controlling the knitting implements having an adjustable cam part for adjusting the length of the plush yarn loops; second cam means for controlling the loop forming implements; and an adjustable cam part for adjustment of the size of the stitches independently from the length of the plush yarn loops.

In a preferred embodiment of the circular knitting machine the loop forming implements each have a drawing edge adapted to form ground yarn loops and becoming active by virtue of a movement of the loop forming implement and the cam part for adjusting the size of the stitches controls the loop forming implements. The loop forming implements can be provided with an upper edge for forming the plush yarn loops, a middle edge for forming ground yarn loops and a lower edge for forming the stitches, support edges for the plush yarn loops being provided at front ends of the upper edges and drawing edges at rear ends of the middle edges.

In another embodiment advantageously a plurality of yarn feeders for feeding the plush yarn are provided in one of the knitting systems and the number of the yarn feeders corresponds to the number of adjustable cam parts in the first cam means.

In the preferred embodiment the first support is a needle cylinder, the second support is a sinker ring and the knitting implements are latch needles. Advantageously the loop forming implements can be clearing and holding down sinkers.

The sinker for a circular knitting machine for making plush fabric according to the invention has an underside; a knocking-over edge spaced from the underside and extending in a longitudinal direction; a middle edge; an upper plush yarn loop forming edge and a nose arranged between the knocking-over edge and the plush yarn loop forming edge, the nose extending in the longitudinal direction and having a lower nose edge and an upper nose edge. The lower nose edge forms a longitudinal fabric holding-down slot with the knocking-over edge and the upper nose edge forming the middle edge at a position between the fabric holding-down slot and the plush yarn loop forming edge;

wherein the middle edge and the plush yarn loop forming edge are connected by a front face having an end adjoining the middle edge formed as a drawing edge for forming ground yarn loops and having a plush yarn loop forming end formed as a support edge for plush yarn loops.

In a preferred embodiment of the sinker the drawing edge is formed by a recess in the front face. Advantageously the upper edge is formed as a support edge for plush yarn loops and this support edge is formed by a recess in the front face.

BRIEF DESCRIPTION OF THE DRAWINGS

The invention will be explained in more detail below in conjunction with the accompanying drawings of an embodiment of a circular knitting machine. These show.

DESCRIPTION OF THE PREFERRED EMBODIMENTS

Figure 1:
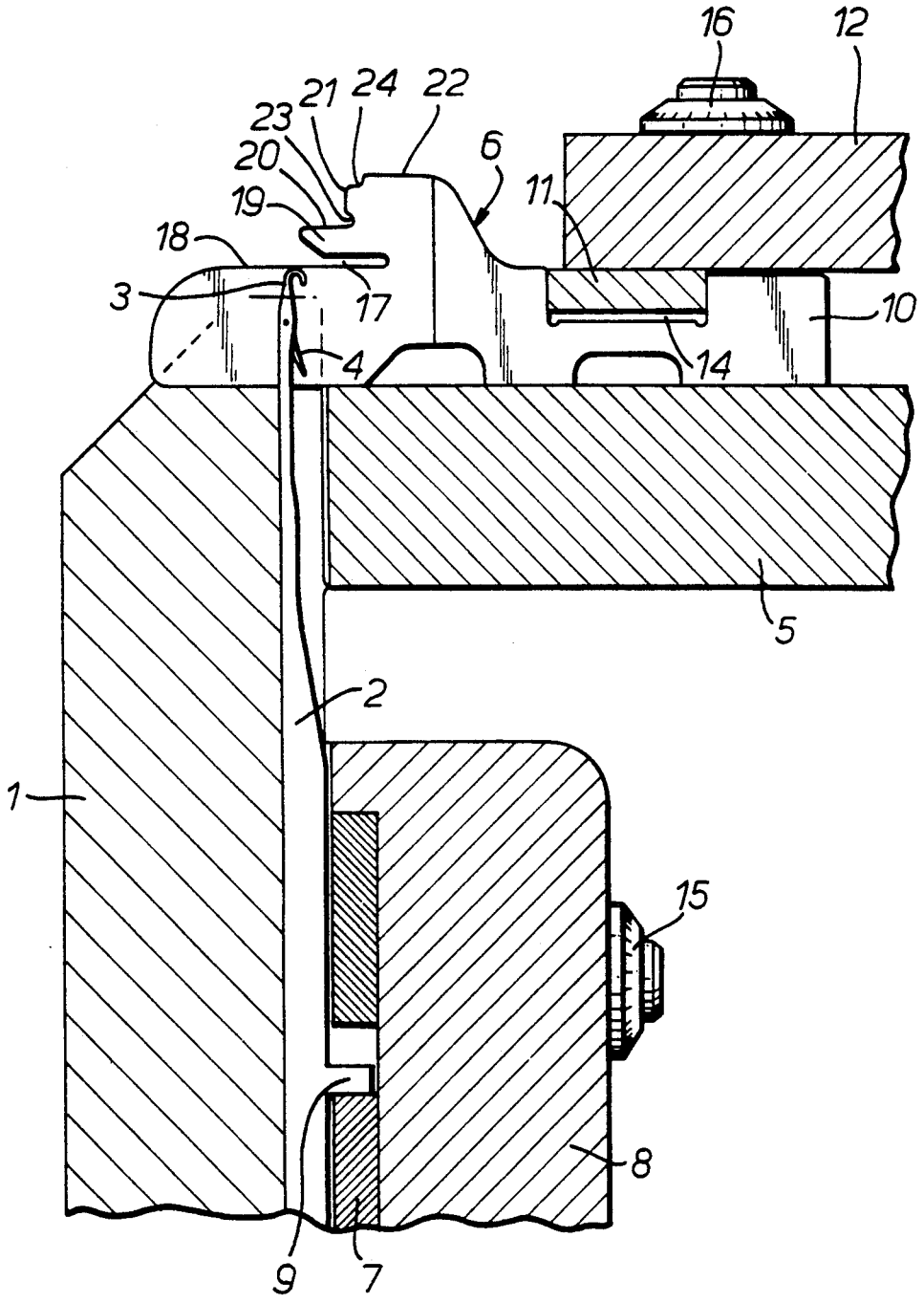
FIG. 1 a schematic axial section through the circular knitting machine in accordance with the invention for making plush goods.

FIG. 1 shows an embodiment of the invention as an example of a circular knitting machine for making plush goods. This circular knitting machine is known in part (DE-OS 3 145 307), so that only parts essential to the invention are explained in detail below.

The circular knitting machine comprises a first support, in the illustrated embodiment a rotatably mounted needle cylinder 1, in which knitting implements, e.g. conventional latch needles 2 with hooks 3 and latches 4 are mounted to move axially, and a second support, here in the form of a sinker ring 5 rotatable with the needle cylinder 1 and in which one-piece loop forming implements, formed in the embodiment as sinkers 6, are mounted for radial movement. The sinkers 6 are arranged in slots of the sinker ring 5 and one such sinker is associated with each needle 2. The needles 2 comprise a butt 9 controlled by cam or lock part sections 7 of a first cam or lock (hereinafter the term "lock" is used instead of "cam" throughout the specification and claims), here formed as a cylinder lock 8, the sinkers 6 each having a butt 10, which is controlled by lock part sections 11 of a second lock formed in the embodiment as a sinker lock 12, which sections engage in a recess 14 formed between the butt 10 and the front side of the sinker. The needle and the sinker lock 8, 12 respectively are components of a lock arrangement, where the needles 2 or other knitting implements and the cylinder lock 8 or other locks serve essentially for the formation of ground and plush yarn stitches and the sinkers 6 or other loop forming implements and the sinker 12 or other locks serve essentially to control the ground and plush yarn loops in the shaping thereof.

For reasons explained further below, the lock part sections 7 are provided with lock parts mounted adjustably in the axial direction on the lock 8 and the lock part sections 11 with lock parts mounted on the lock 12 adjustably in the radial direction. Adjusting screws 15, 16 respectively serve for adjustment of these lock parts, these screws acting through eccentrics or the like in a manner known per se on sliders, not further shown, mounted movably in the lock 8 or 12 and to which the adjustable lock parts are fixed.

The loop forming implements are formed as clearing and holding down sinkers and comprise elements provided for handling a ground yarn and a plush yarn. In particular the sinkers 6 comprise a longitudinally extending lower edge 18 above their lower sides which are guided on the bottoms of the sinker ring grooves, each such edge passing into a longitudinal slot 17 or a throat, and also comprise a nose 19 thereabove, likewise extending in the sinker longitudinal direction and which delimits the slot 17 with its lower edge and which is provided on its upper side with a middle edge 20. This is connected via a short front face 21 projecting in the direction of the front end of the nose 19 and extending substantially perpendicular to the edge 18 to a still higher upper edge 22 running towards the rear, the edges 18, 20 and 22 being arranged substantially parallel to one another. Moreover the nose 19 is shorter than the lower edge 18, measured from the bottom of the longitudinal slot 17 and the upper edge 22 is shorter than the nose 19.

At each of the upper and lower ends of the front face 21 there is provided a recess, the lower recess forming a drawing edge 23 for a ground yarn and the upper recess forming a support edge 24 for a plush yarn.

Figure 2:
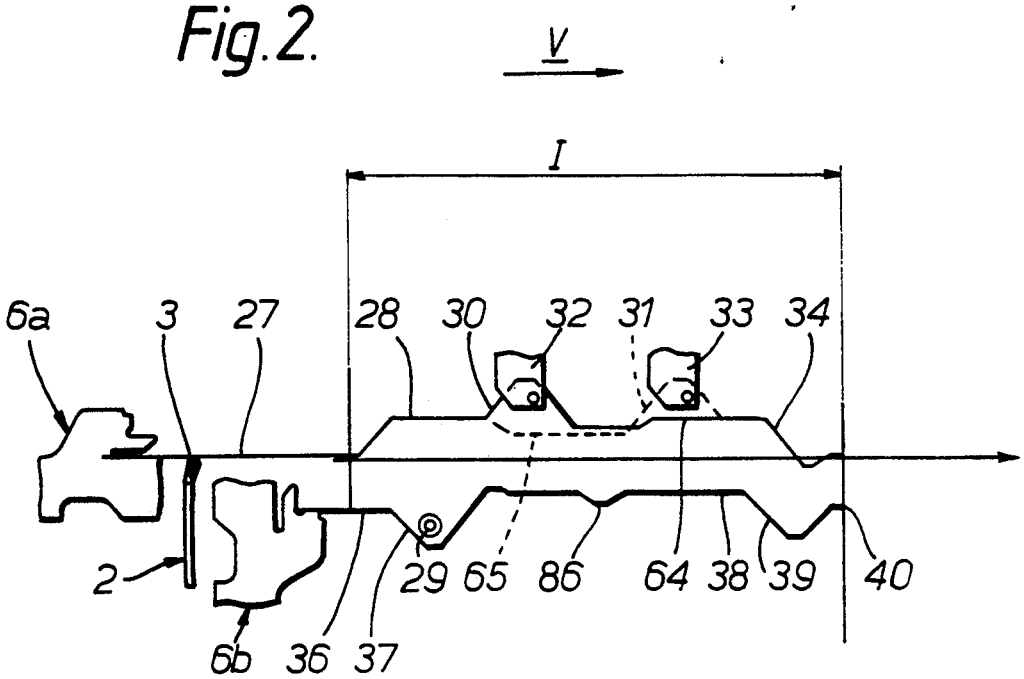
FIG. 2 shows schematically the lock development of a knitting system of the circular knitting machine according to FIG. 1.

FIG. 2 shows a view to a smaller scale than FIG. 1 of the lock paths formed by the lock sections 7, 11 of a system I with a movement of the needles in the direction of an arrow v. In the left part of FIG. 2 it is indicated that the upper edges of the hooks 3 are normally guided on a circulation track 27 which— regarded in the axial direction—runs at the level of the edges 18 of the sinkers 6 shown in a position 6*a*, this position being for making clear the relative positions of the hooks 3 and the sinkers 6 in the axial direction. From the circulation track 27 the needles 2 can be transferred in the knitting system I shown in FIG. 2 firstly to an intermediate position, namely a tuck position, in which the upper hook end is arranged on a track section 28, in which it is possible to lay in a ground yarn by means of a schematically shown yarn feeder 29. Then the needles 2 can be further raised selectively at two positions such that the upper edges of the hooks 3 are guided on a first or a second triangular track section 30, 31 respectively, which allow like or differently constituted plush yarns to be laid in by means of schematically shown yarn feeders 32, 33. Then the upper edges of the hooks 3 are retracted again along a withdrawal section 34 to the circulation track 27.

In the upper left part of FIG. 2 there is shown schematically a second sinker position 6*b*. Through this the positions of the front faces 21 of the sinkers 6 relative to the needles 2 are to be shown in the radial direction. Accordingly, the front faces 21 are so guided on a track section 36 when the hooks 3 are in the circulation track that they are arranged substantially in the extension of the longitudinal axes of the needle shanks, i.e. above the hooks 3. From this position the sinkers are first retracted radially from the needle circle along a triangular track section 37, in order to make space for the yarn feeder 29, and are then pushed in again radially in the direction of the needle cylinder up to a track section 38, in which the front faces 21 are arranged somewhat further radially inwards than corresponds to the track section 37. At the end of the system the front faces 21 are pushed first radially outwardly by means of a further triangular track section 39 and then radially in to a track section 40 running at the level of the track section 36, in order to facilitate the formation of the stitches in the region of the withdrawal region 34.

Figure 3:
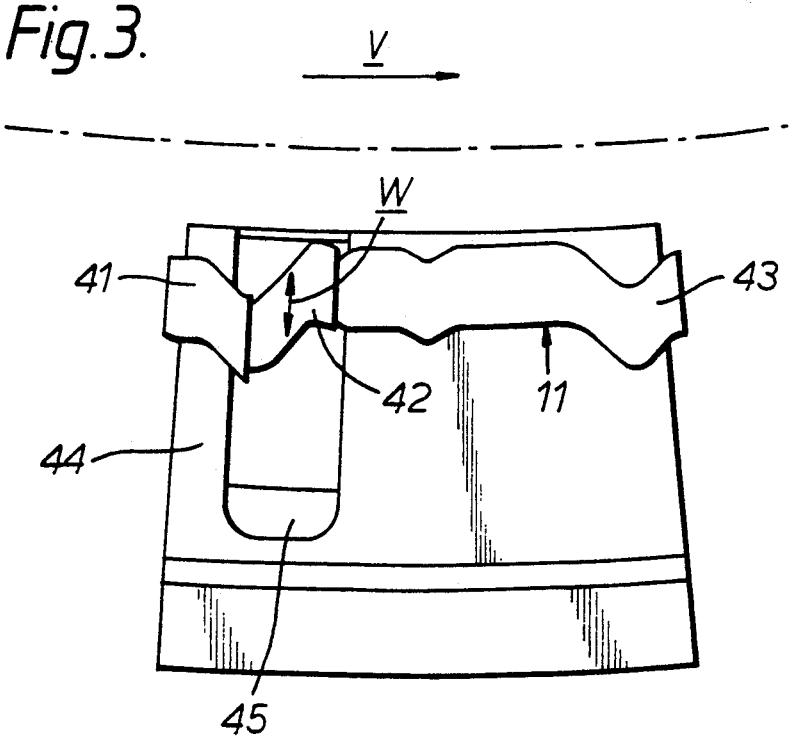
FIG. 3 shows details of the sinker cam part section of the circular knitting machine according to FIG. 1.

In FIG. 3 the lock part section 11 (cf. also FIG. 1) used to implement the sinker track sections 36 to 40 according to FIG. 2 is shown. The lock part section 11 consists of three lock parts 41, 42 and 43 arranged one after another in the direction of the arrow v, whose support plate 44 has a recess 45 in the region of the track section 37, in which recess is fitted a slide carrying the lock part 42 so as to be radially movable in the direction of a double arrow w. This slide is coupled via an eccentric or the like to the adjusting screw 16 shown in FIG. 1. In order that, in the passage of the sinkers 6 from the lock part 41 to the lock part 42 and from this to the lock part 43 in the direction of the arrow v, there shall be no edges or the like interfering with the sinkers, the width of the lock part 42 is smaller at its left, run-in side and greater at its right, run-out side than the respective adjoining part of the lock part 41 or 43, as can be seen clearly from FIG. 3, whereby the magnitude of the range of adjustment in the direction of the arrow w is also established.

The sinker lock part sections 11 at all knitting systems of the circular knitting machine are moreover preferably formed identically, so that the sinker lock 12 can only be adjusted by means of the adjusting screws 16. A sinker selection mechanism is neither provided nor necessary.

Figure 4:
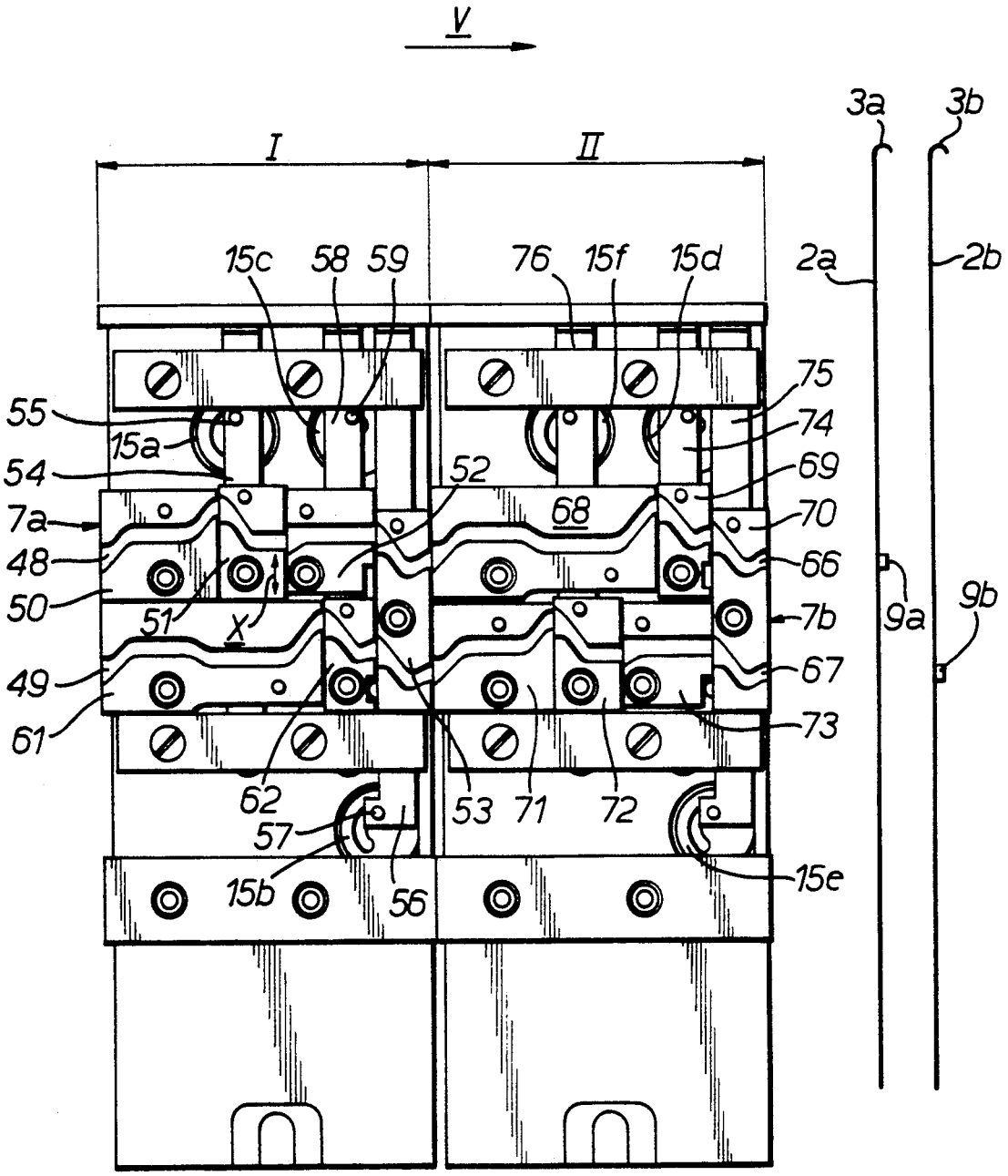
FIG. 4 shows details of the cylinder cam part sections of two adjacent knitting systems of the circular knitting machine according to FIG. 1.

FIG. 4 shows two lock part sections 7*a* and 7*b* of the cylinder lock 8 used to implement the needle track sections 27, 28, 30, 31 and 34 according to FIG. 2 of the cylinder lock 8 (cf. also FIG. 1). Although the lock part sections 7*a*, 7*b* in all knitting systems of the circular knitting machine can be formed identically, the use of different lock part sections 7*a*, 7*b* is preferably also possible, in order to be able to make stitch or colour patterns in a simple manner. Accordingly in FIG. 4 the different lock part sections 7*a* and 7*b* of two knitting systems I and II are shown beside each other. The lock part sections 7*a*, 7*b* cooperate with needles 2*a*, 2*b* having hooks 3*a*, 3*b* and which have their butts 9*a*, 9*b* respectively distributed at different heights, e.g. in the ratio 1:1 in the grooves of the needle cylinder 1. Accordingly an upper needle path 48 is associated with the needles 2*a* and a lower needle path 49 with the needles 2*b*.

In the region of the knitting system I the lock part section 7*a* comprises, again regarded in the direction of the arrow v, four lock parts 50 to 53 lying one after another and forming the substantially closed needle path 48 for the butts 9*a*. The lock part 50 raises the butts 9*a* firstly into the intermediate or tuck position corresponding to the track section 28 (FIG. 2) for the purpose of receiving a ground yarn and then into the highest position corresponding to the rising part of the triangular track section 30 (FIG. 2), so that the needles 2*a* in the following retraction to the intermediate position can receive a plush yarn. The retraction is here adjustable in the axial direction by means of the lock part 51, i.e. parallel to a double arrow x, since the lock part 51 is fixed on a slide 54 which is coupled through an eccentric 55 to an adjusting screw 15*a* corresponding to the adjusting screw 15 of FIG. 1.

The lock part 51 is followed by the fixedly positioned lock part 52 with a track section running substantially in a straight line at the level of the intermediate position. Through this the hooks 3*a* corresponding to FIG. 2 are held in the intermediate position (track section 64 in FIG. 2) until they have passed the second plush yarn feeder 33 without receiving a plush yarn. The fourth lock part 53 is a retracting lock part which is provided with a upper needle track corresponding to the track section 34 of FIG. 2 and is fixed to a further slide 56, which is coupled through a further eccentric 57 to an adjusting screw 15*b* and is mounted for movement parallel to the double arrow x.

The likewise substantially closed lower needle path 49 for the butts 9*b* of the needles 2*b* is firstly formed by two lock parts 61 and 62 lying one after another in the direction of the arrow v. The lock part 61 is fixed and serves to guide the butts 9*b* in such a way that the hooks 3*b* of the needles 2*b* are firstly raised to the intermediate or tuck position (track section 28 in FIG. 2), in order to receive the ground yarn, but are then retracted to a somewhat deeper lying position (track section 65 in FIG. 2), in order to pass the plush yarn feeder 32 without receiving a plush yarn. At the end of the lock part 61 there is then provided a section leading to the highest needle position, corresponding to the rising part of the track section 31 (FIG. 2), so that the needles 2*b* can receive a plush yarn at the plush yarn feeder 33.

The adjoining lock part 62 is, like the lock part 51, fixed on a slide 58 with eccentric 59 and adjusting screw 15*c* and serves so to guide the butts 9*b* that the hooks 3*b* are retracted to the intermediate position on a track section corresponding to the falling part of the track section 31 (FIG. 2). A lower track section of the lock part 53 follows on the lock part 62, being likewise formed in correspondence with the track section 34 (FIG. 2). The lock parts 50 to 53, 61 and 62 as well as the lower needle path of the lock part 53 are so formed at their in-feed and out-feed sides that no projecting edges interfering with the butts 9*a* or 9*b* occur within the possible range of adjustment of the adjusting screws 15*a* to 15*c*.

The lock part section 7*b* has an upper, substantially closed needle path 66 acting on the butts 9*a* and a lower substantially closed needle path 67 acting on the butts 9*b*. The needle path 66 is formed by lock parts 68, 69 and 70 following one another in the direction of the arrow v, which correspond precisely to the lock parts 61, 62 and 53, so that the needle path 66 is formed like the needle path 49. On the other hand the needle path 67 is formed by lock parts 71, 72 and 73 following one another in the direction of the arrow v, which correspond to the lock parts 50, 51 and 52, and a lower needle path of the lock part 70, so that the needle path 67 corresponds precisely to the needle path 48. Accordingly the lock parts 69, 70 and 72 are fixed on slides 74, 75 and 76 and are adjustable by means of adjusting screws 15*d*, 15*e* and 15*f*.

Figure 5:
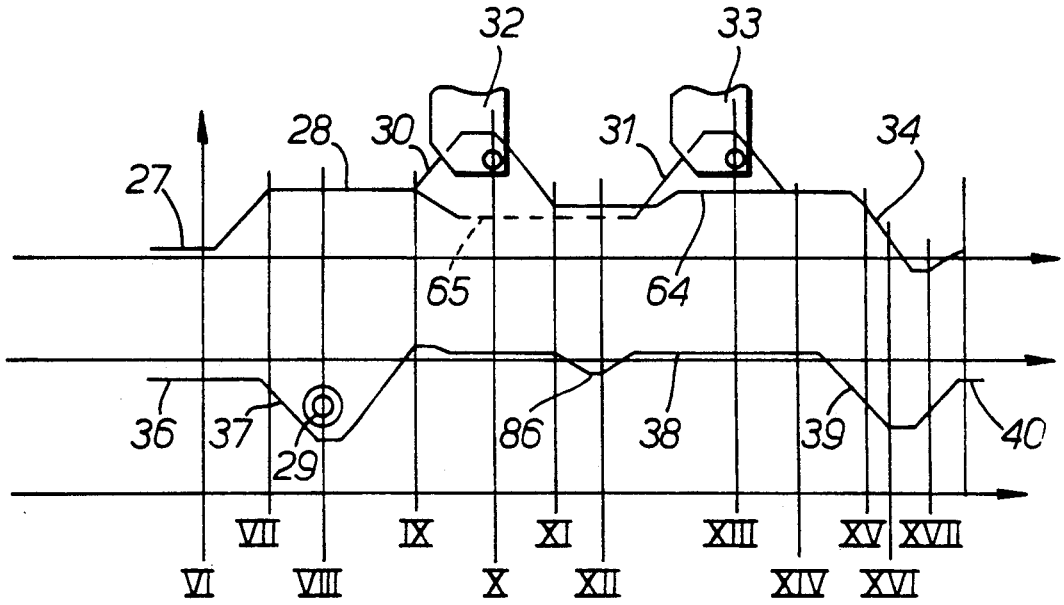
FIG. 5 shows a view corresponding to FIG. 2 to a larger scale.

FIG. 5 is an enlarged representation of the track sections shown in FIG. 2 and includes additional section lines VI–XVII for FIGS. 6 to 17, on the basis of which the manner of operation of the circular knitting machine according to FIGS. 1 to 4 will now be explained.

Figure 6:
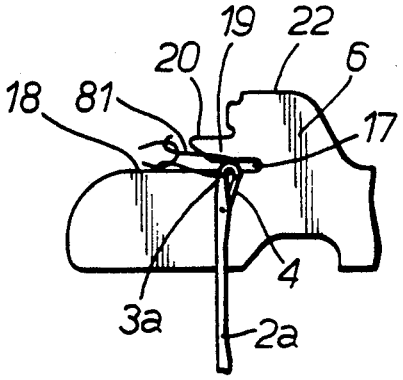
FIGS. 6 to 17 show relative positions of the needles and sinkers at the positions indicated VI–XVII in FIG. 5.
Figure 7:
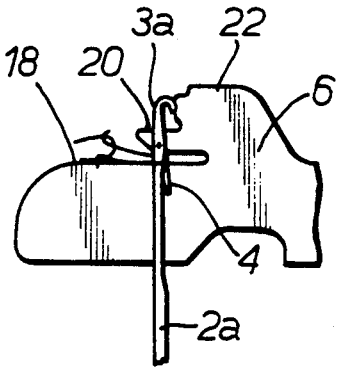

In FIG. 6 all needles 2*a* and the associated sinkers 6 are in their base or non-knitting position, in which each hook 3*a* holds a stitch 81 formed in a preceding system. The latches 4 are still closed and the old stitches 81 are so retained in the longitudinal slots 17 of the sinkers 6 that the knitting is held at the level of the lower edges 18 of the sinkers 6 when the needles 2*a* rise. The needles 2*a* are firstly raised to the intermediate position according to FIG. 7 from the base position according to FIG.

6 by the lock part 50 according to FIG. 4 (track section 28 in FIG. 4), until their latches 4 are opened by the old stitches 81 and the lower ends of their hooks 3a are sufficiently far above the middle edges 20 of the sinkers 6.

Figure 8:
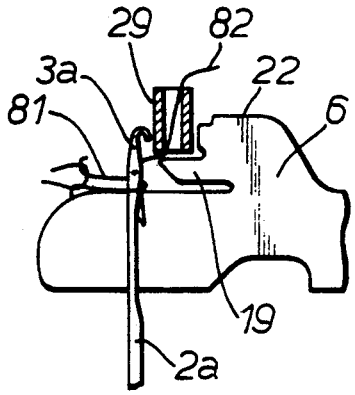
Figure 9:
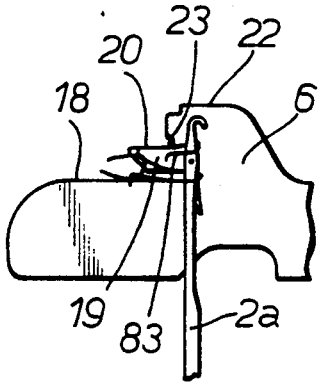

In accordance with FIGS. 3 and 5 the retraction of the sinkers 6 now takes place along the track section 37, in order to make space for the yarn feeder 29, whose outlet end for a ground yarn 82 fed thereby lies closely above the noses 19 of the sinkers 6 (FIG. 8).

After the needles 2a have received the ground yarn 82, the sinkers 6 are advanced again in the direction of the needles 2a in accordance with FIGS. 3 and 5. Through this the ground yarn 82 lies against the drawing edge 23 of the sinkers 6 (FIG. 9), so that, on further advance of the sinkers 6 such as to bring the drawing edges 23 behind needle backs, loops 83 are formed from the ground yarn 82. The length of these loops 83 depends in accordance with the invention on how the lock part 42 (FIG. 3) is adjusted by means of the adjusting screw 16 in the direction of the double arrow w. It results from this that, in accordance with the invention and contrary to the case with other circular knitting machines, the formation (preliminary loop formation) of the loop 83 of the ground yarn 82 is not effected with the aid of an adjustable lock part acting on the needles or knitting implements, but with the aid of an adjustable lock part acting on the sinkers or loop-forming implements. The sinkers 6 can now be retracted somewhat between the section lines IX and X according to FIG. 5, in order to remove tension from the formed loops 83. Then the needles 2a are driven with the aid of the lock part 50 (FIG. 4) from the intermediate position, in which the old stitches 81 still lie on the open latches, up to their highest position (track section 30 in FIG. 5), in which position the lower ends of the hooks 3a are sufficiently far above the upper edges 22 of the sinkers 6. In this the positions of the various edges of the sinkers and the dimensions of the lock parts involved are so selected that, in driving the needles out of the intermediate position (FIG. 9) into their highest position (FIG. 10), on the one hand the old stitches 81 slide below the latches 4 onto the shanks of the needles 2a and on the other hand the newly formed loops 83 still lie on the open latches 4.

Figure 10:
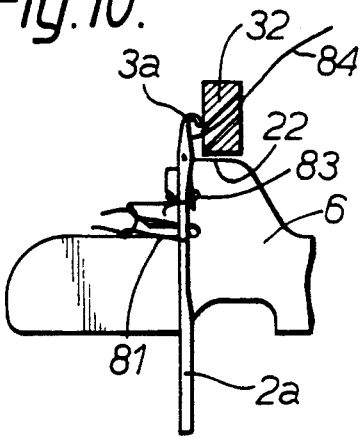
Figure 11:
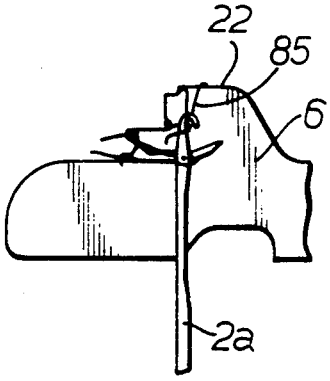

With renewed retraction of the needles into the intermediate position, their hooks 3a initially accept a plush yarn 84, which is fed from the plush yarn feeder 32, whose outlet end is arranged closely above the upper edges 22 of the sinkers 6. On retracting the needles 2a the plush yarn 84 is therefore supported on the upper edges 22, so that plush yarn loops 85 from (FIG. 11). The length of these loops 85 depends in accordance with the invention how the lock part 51 is set in the direction of the double arrow x, i.e. on how deeply the needles 2a are retracted in the retraction into the position according to FIG. 11. The length of the loops 85 is adjustable somewhat in a range which results from the needle positions according to FIGS. 10 and 11. Accordingly the invention is especially suited also to making short loop plush goods, in which the length of the plush yarn bows or loops 85 amounts to about 1.0 to 2.0 mm.

Figure 12:
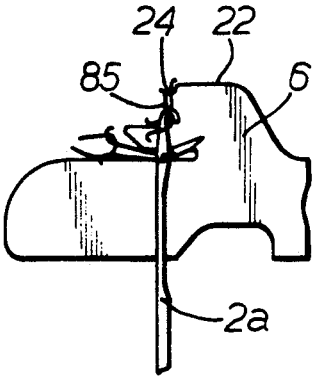

FIG. 12 shows finally that the sinkers 6 are firstly retracted somewhat and then advanced somewhat again after the formation of the plush yarn loops 85, along a triangular track section 86 (FIG. 5) of the sinker lock. This serves firstly to allow the loop 85 formed on the uppermost edge 22 to slide onto the support edge 24 and then to tighten again, or remain tight, until the stitch formation operation is started.

The needles 2b are moved in the system I by means of the needle path 49 firstly into the intermediate position corresponding to the track section 28 in FIG. 5, so that, like the needles 2a, they receive the ground yarn 82 (FIG. 8) laid in from the ground yarn feeder 29. The sinker movement is thus precisely as in the case of the needles 2a, i.e. the length of the pre-formed ground yarn loops is dependent on the advance of the sinkers 6 along the lock part 42. Then however the needles 2b are retracted to the intermediate position (section 65 in FIG. 5), so that they pass the plush yarn feeder 32 without receiving the plush yarn 84 there (FIG. 10), i.e. their hooks 3b are sufficiently far below the upper edges 22 of the sinkers 6.

After passing the plush yarn feeder 32 the needles 2b are raised to their highest position along the triangular shaped track section 31 (FIG. 5) in the same way as in FIGS. 10 and 11, so that they firstly allow the old stitches to slide below the latch tips and then in the following retraction by means of the lock part 62 (FIG. 4) receive a plush yarn 87 fed from the plush yarn feeder 33 (FIG. 13) and can shape this into plush yarn loops 88 (FIG. 14) over the edges 22 of the sinkers 6, where the length of the plush yarn loops 88 is adjusted by means of the lock part 62 or the adjusting screw 15c. At the same time the plush yarn feeder 33 is passed by the needles 2a, without these receiving the second plush yarn 87, since the hooks of the needles 2a at this time are guided on the track section 64 (FIG. 5).

Figure 16:
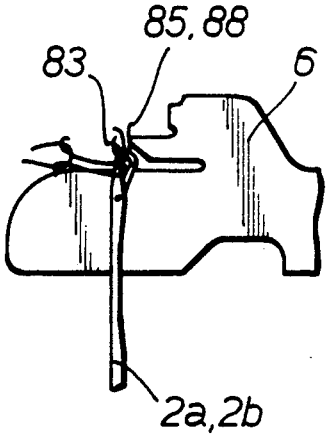
Figure 17:
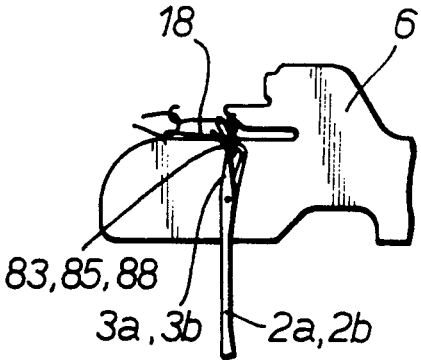

After all needles 2a have formed a loop 85 from the first plush yarn 84 in this way and all needles 2b have formed a loop 88 from the second plush yarn 87 and all needles 2a and 2b have formed a loop 83 form the ground yarn 82, retraction of all sinkers 6 follows, to a position lying so far back that firstly the preformed plush yarn loops 85 slide off the support edges 24 and the pre-formed plush yarn loops 88 slide off the upper edges 22, both on to the middle edge 20 of the noses 19 (FIG. 15) and then together with the ground yarn loops 83 also slide off the noses 19 (FIG. 16). Then follows the actual stitch formation (FIG. 17) in a manner known per se, in that the hooks 3a, 3b are retracted below the edges 18 of the sinkers 6, so that stitches are formed from the loops 83, 85, 88 as the case may be and the old stitches are cast off over the hooks 3a,b. The depth of the withdrawal of the needles 2a,b can be adjusted with the aid of adjusting screw 15b acting on the lock part 53 and can be matched to the loop length set with the lock parts 42 (FIG. 3). As shown in FIGS. 5 and 15 to 17, the required sinker and needle movements can take place with small offset in sequence along the track sections 39 and 34. Finally, the sinkers 6 are pushed forward again on the track section 40 while the needles 2a,b are raised somewhat to take the tension out of the stitches, so that the base position according to FIG. 6 again results.

Figure 13:
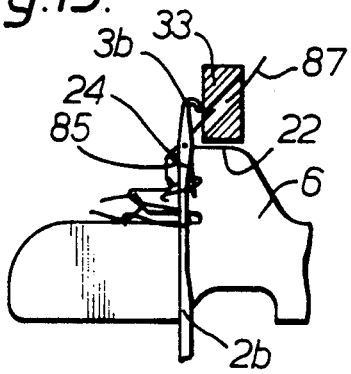
Figure 14:
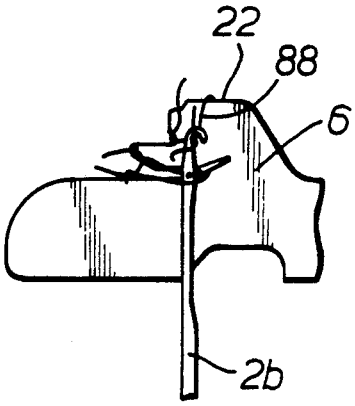
Figure 15:
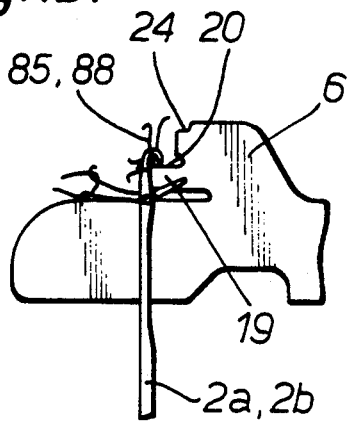

As can be seen especially from FIG. 13, the support edges 24 serve the purpose of disposing the loops 85 formed by means of the needles 2a behind the needle backs, by advance of the sinkers 6, before the needles 2b are driven out, in order to receive the plush yarn 87. In this way damage to or penetration of the loops 85 by the needles 2b is avoided. Accordingly it will be understood that the support edges 24 are not needed if only one plush yarn is fed in at each system.

Figure 18:
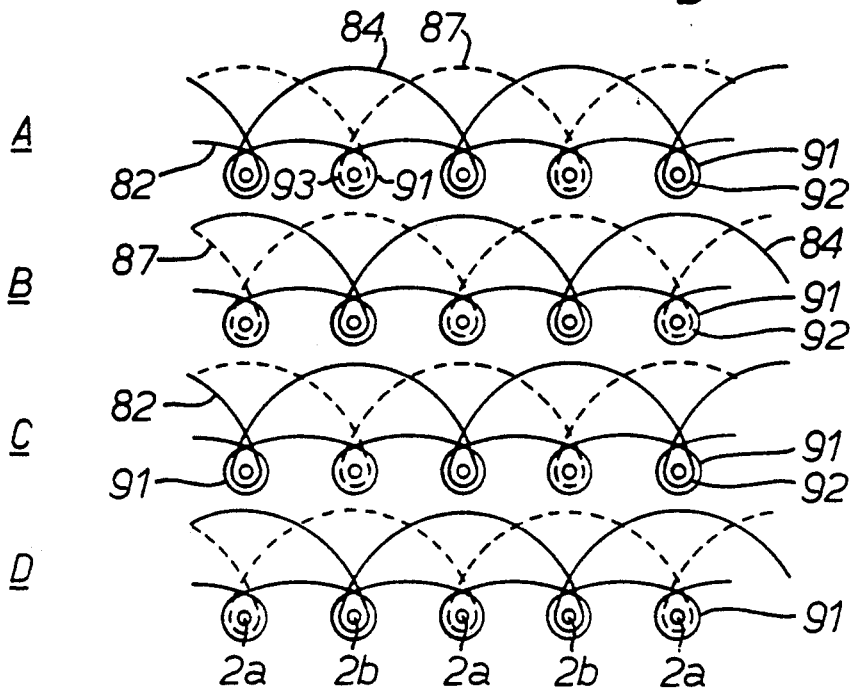
FIGS. 18 and 19 show schematic views of plush goods made with the circular knitting machine according to FIGS. 1 to 17.

In the following system II the loop and stitch formation is effected in similar manner to system I but with the difference that the needles 2b now receive a plush yarn at a plush yarn feeder corresponding to the first plush yarn feeder 32 and the needles 2a receive a plush yarn at a plush yarn feeder corresponding to the second plush yarn feeder 33. The described operations are repeated at following systems, not shown. If accordingly at each first plush yarn feeder 32 of a system group formed from two systems a plush yarn with a first characteristic, e.g. colour is fed in and at each second plush yarn feeder 33 of the same system group a plush yarn of a second characteristic is fed in, there results a plush material of which four rows of stitches A to D are shown in FIG. 18. Here the ground yarn 82 is worked into stitches 91 by all needles 2a,b, indicated schematically by a black dot, in all four stitch rows A to D. On the other hand, the needles 2a form a stitch 92 with the first plush yarn 84 indicated in full lines and the needles 2b form a stitch 93 with the second plush yarn 87 indicated in broken lines in the stitch rows A and C while in the stitch rows B and D the needles 2a work the plush yarn 87 to the stitches 92 and the needles 2b work the plush yarn 84 to the stitches 93. Overall a 1:1 plush material thus results with identical stitch rows but offset each time by one stitch, in which each plush loop extends over two needles 2a or 2b.

Figure 19:
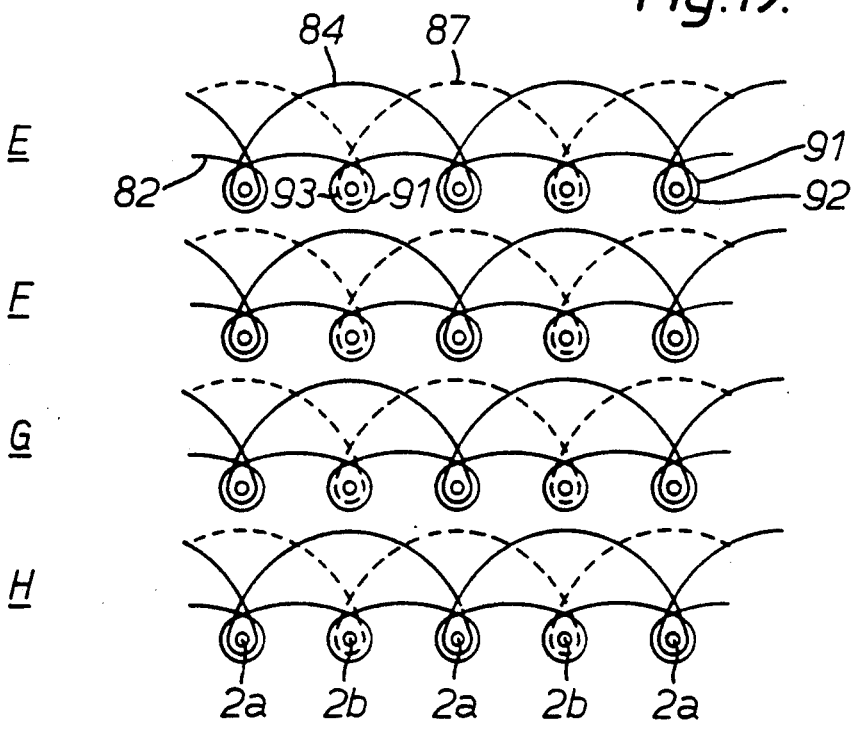

Through simple alterations to the cylinder lock 8, numerous plush materials different from FIG. 18 can be made with the described circular knitting machine. If for example the lock parts 68, 69 on the one hand and 71, 72 and 73 on the other hand are interchanged in FIG. 4, the needles 2a in each case take up the first plush yarn 84 and the needles 2b the second plush yarn 87 in the systems I and II Accordingly there results the plush material shown in FIG. 19, which differs from that according to FIG. 18 only in that the illustrated stitch rows E to H are not only identical but are also not offset.

Figure 20:
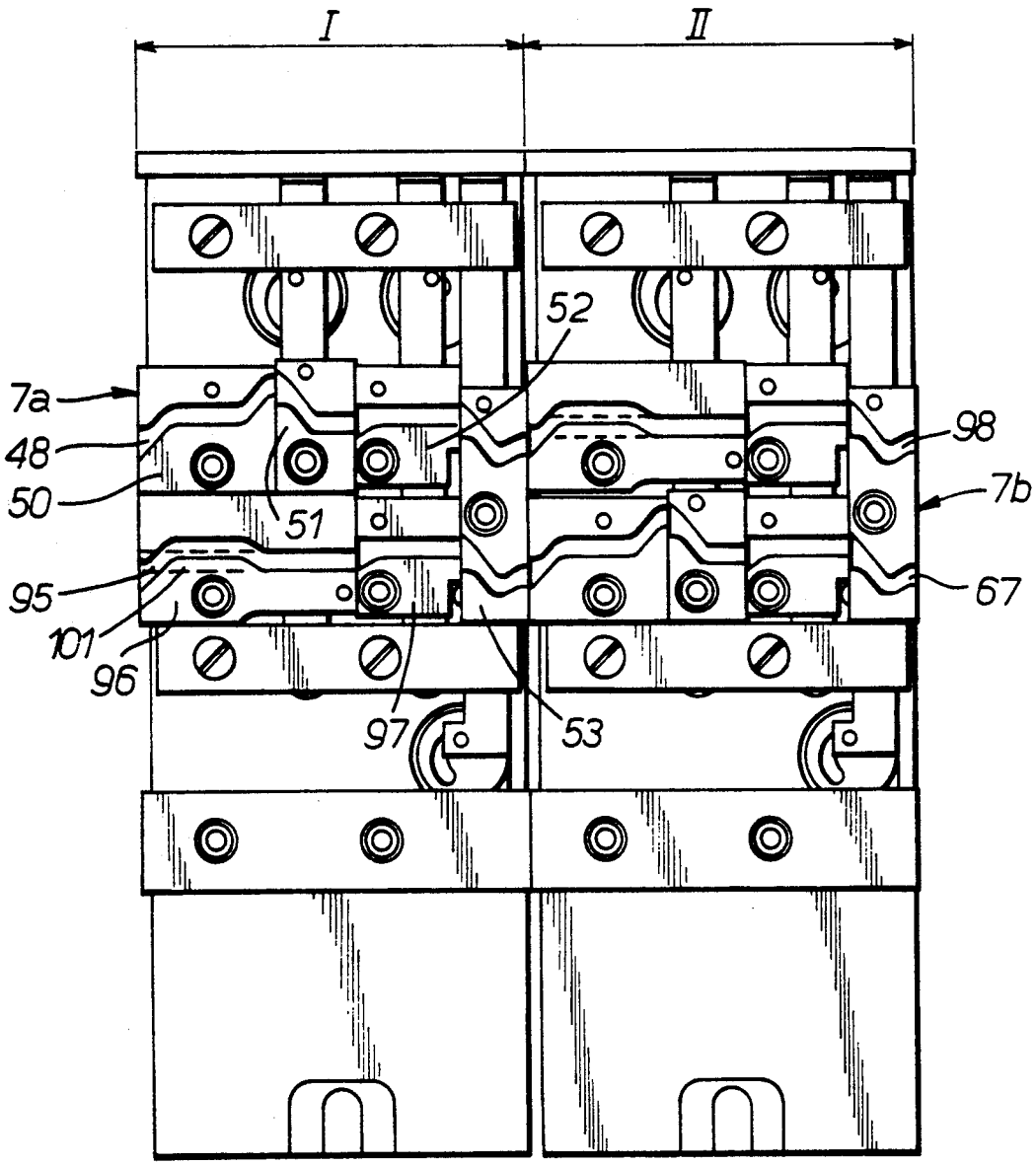
FIG. 20 shows a representation corresponding to FIG. 4 of the cylinder cam part sections according to a further embodiment of the invention.
Figure 21:
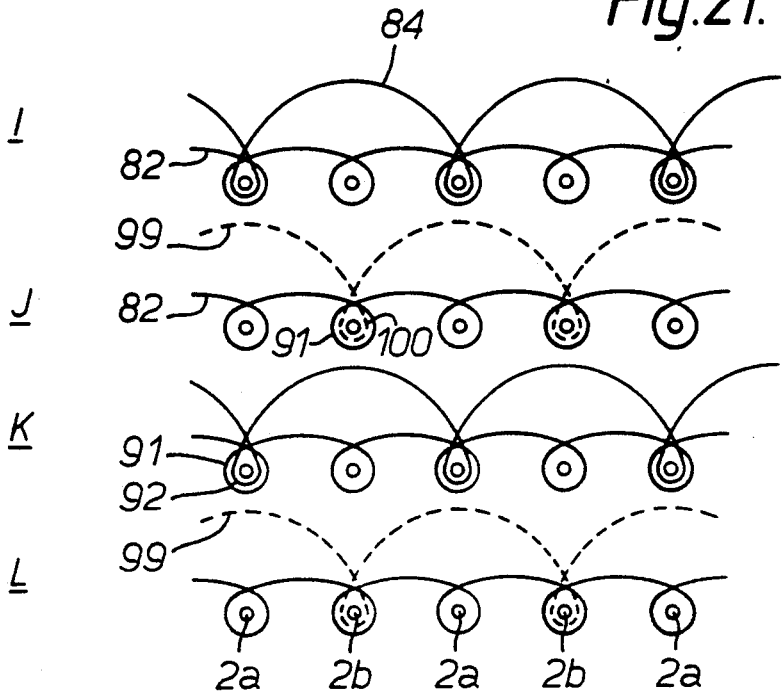
FIGS. 21 and 22 show schematic views of two further plush goods which can be made with the circular knitting machine according to FIG. 20.

A further possible alteration of the cylinder lock is shown in FIG. 20. Here the upper needle path 48 of the lock part section 7a and the lower needle path 67 of the lock part section 7b correspond to those according to FIG. 4. However, the lower needle path 95 is formed by a lock part 96 extending over the width of the lock parts 50, 51, a lock part 97 corresponding to the lock part 52 and the lock part 53, the lock part 96 being fixed in position and raising the associated needles 2b firstly into the position required to receive ground yarn 82 but then retracting them again to an intermediate position, in order to ensure that only the needles 2a receive the first plush yarn 84. An upper needle path 98 of the lock part section 7b is correspondingly formed. As a result of this a plush material (FIG. 21) is obtained in which the ground yarn 82 is worked into stitches 91 by all needles 2a, 2b in stitch rows I to L, while the plush yarn 84 is worked into the stitches 92 in the stitch rows I, K, etc. only by the needles 2a. Similarly a plush yarn 99 is worked into stitches 100 in the stitch rows J, L, etc. only by the needles 2b. In this the plush yarns 84 and 99 can have the same or different characteristics. In each case the plush yarn loops extend over two needles, only every second needle forms a plush yarn stitch and the wales with plush yarn stitches are offset from row to row by one wale.

A further variant results if the first parts of the needle paths 95 and 98 are formed in the way shown in FIG. 20 by a broken line. Then the needles 2b in system I and the needles 2a in system II are raised in each case so little that they cannot receive the ground yarn 82 at the yarn feeders 29. The resulting plush material corresponds to that of FIG. 21 with the difference that, in the stitch rows I, K, etc. the stitches 91 formed by the needles 2b alone and in the stitch rows J, L, etc. correspondingly the stitches 91 formed by the needles 2a alone are missing and are replaced by floats.

Figure 22:
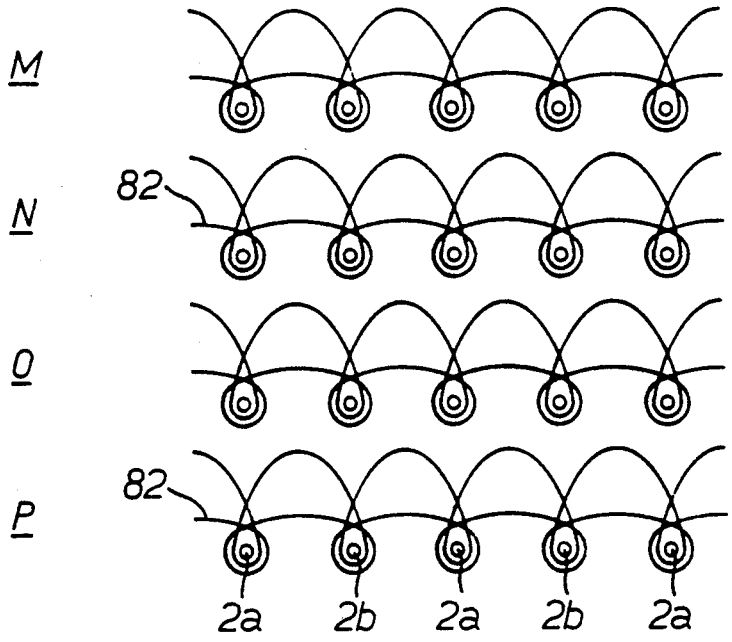

Naturally it is also possible with the described circular knitting machine to make the full plush material shown in FIG. 22. The illustrated stitch rows M to P of this plush material are identically formed in each case and are made with plush yarns of the same or different characteristics, while all needles 2a, 2b work the same ground and plush yarns into stitches. Such a plush material is obtained e.g. in that the lower needle path 49 of the lock part section 7a in FIG. 4 is replaced by the lower needle path 67 of the lock part section 7b and all systems are moreover formed identically and provided with identical lock part sections 7a.

The invention is not limited to the described embodiments, which can be modified in numerous ways. This applies above all to the needle paths and lock part sections described with reference to FIGS. 2 to 4 and 20. In particular, more than two plush yarn feeders 32, 33 can be associated with each of the individual knitting systems I, II in order for example to make Jacquard plush material in conjunction with needle selection devices, not shown. Correspondingly, knitting systems or system groups could be provided at which only the ground yarn or only a ground yarn and a single plush yarn are fed in. It is furthermore possible to implement the adjustment of the lock parts 51, 52, 53, etc. with means other than those shown. In particular it would be possible to provide for this so-called central adjusting devices which make possible e.g. a central axial raising or lowering of the needle cylinder and the sinker ring or of the cylinder lock. Furthermore it would be possible to provide the cylinder lock part section 7 with only a single needle path in each case (e.g. 48 or 49) and to use corresponding needles with only one associated butt 9a or 9b. The needles can naturally also be provided with butts serving further, different purposes. Furthermore the invention is not limited to adjusting the length of the ground yarn loops by means of the sinkers 6. It would be fundamentally possible to preform the ground yarn loops in conventional manner such that the ground yarn is laid over the middle edges 20 of the sinkers 6 and the needles are then retracted by means of lock parts (DE-PS 3 145 307). If adjustable lock parts are used for this, the advantage is obtained in this case also that the length of the ground and plush yarn loops can be adjusted individually by different means. In all cases the needles 2a, 2b described with reference to FIG. 4 can be arranged in distributions other than 1:1.

Furthermore the invention is not limited to the use of the illustrated cylinder needles and clearing and holding down sinkers, in the place of which other knitting and loop-forming implements, especially in the form of dial needles, draw hooks or the like with other elements than correspond to the parts 18 to 22, can be provided and which can be mounted in supports other than those described, especially in a dial. Furthermore it would be possible to provide no preliminary loop formation for the ground yarn but to let this pass freely through the longitudinal slots 17 or throats of the sinkers 6 up to the place at which the stitches are formed (e.g. line XVI in FIG. 5), as is basically already known (EP-AS 0 295 703). Also in this case different lock parts could be provided to adjust the length of the plush yarn loops and size of the stitches. Finally the ground yarn could be preformed differently from FIG. 9 with the closed ends of the longitudinal slots 17, in that the sinkers 6 are suitably advanced and the plush yarn loops are merely formed over the edges 20 of the sinkers 6. In this case the edges 22 can be omitted. However the length of the plush yarn loops could again be controlled by a suitable cylinder lock part, the size of the stitches however by a suitable sinker lock part.

While the invention has been illustrated and described as embodied in a large diameter circular knitting machine having knitting needles in the cylinder and sinkers in the sinker ring, it is not intended to be limited to the details shown, since various modifications and structural changes may be made without departing in any way from the spirit of the present invention, particularly with respect to other circular knitting machines. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A circular knitting machine for making plush fabric, and circular knitting machine comprising a first support with knitting implements for making stitches; a second support with loop forming implements for making loops, said second support having means for handling a ground yarn and a plush yarn; and at least one knitting system for forming stitches having a size and consisting of the ground yarn and the plush yarn and for forming loops having a length and formed solely from the plush yarn;

wherein said at least one knitting system includes at least one yarn feeder for feeding the ground yarn; at least one yarn feeder for feeding the plush yarn; first cam means for controlling the knitting implements, said first cam means having an adjustable cam part for adjusting the length of the plush yarn loops; second cam means for controlling the loop forming implements; and an adjustable cam part for adjustment of the size of the stitches independently from the length of the plush yarn loops.

2. A circular knitting machine according to claim 1, wherein the loop forming implements each have a drawing edge adapted to form ground yarn loops and becoming active by virtue of a movement of said loop forming implement and the cam part for adjusting the size of the stitches controls the loop forming implements.

3. A circular knitting machine according to claim 1, wherein the loop-forming implements have a support edge for the plush yarn loops.

4. A circular knitting machine according to claim 1, wherein the loop forming implements are provided with an upper edge for forming the plush yarn loops, a middle edge for forming ground yarn loops and a lower edge for forming the stitches.

5. A circular knitting machine according to claim 1, wherein the loop forming implements have upper edges and support edges provided at front ends of the upper edges.

6. A circular knitting machine according to claim 4, wherein the loop, forming implements are provided with drawing edges at rearward ends of the middle edges.

7. A circular knitting machine according to claim 1, wherein the at least one knitting system has a number of said yarn feeders for feeding the plush yarn and the first cam means for controlling the knitting implements has a number of said adjustable lock parts corresponding to the number of said yarn feeders in said at least one knitting system.

8. A circular knitting machine according to claim 1, wherein the first support is a needle cylinder.

9. A circular knitting machine according to claim 1, wherein the second support is a sinker ring.

10. A circular knitting machine according to claim 1, wherein the knitting implements consist of latch needles.

11. A circular knitting machine according to claim 1, wherein the loop forming implements consist of clearing and holding down sinkers.

12. A sinker for a circular knitting machine for making plush fabric, said sinker having an underside; a knocking-over edge (18) spaced from the underside and extending in a longitudinal direction; a middle edge (20); an upper plush yarn loop forming edge (22) and a nose (19) arranged between said knocking-over edge (18) and said plush yarn loop forming edge (22), said nose extending in the longitudinal direction and having a lower nose edge and an upper nose edge, said lower nose edge forming with said knocking-over edge (18) a longitudinal fabric holding-down slot (17) and said upper nose edge forming said middle edge (20) at a position between said fabric holding-down slot (17) and said plush yarn loop forming edge (22);

wherein said middle edge (20) and said plush yarn loop forming edge (22) are connected by a front face (21) having an end adjoining said middle edge (2) formed as a drawing edge (23) for forming ground yarn loops and having a plush yarn loop forming end formed as a support edge (24) for plush yarn loops.

13. A sinker according to claim 12, wherein the drawing edge is formed by a recess in the front face.

14. A sinker according to claim 12, wherein an end of the front face adjoining the upper edge is formed as a support edge for the plush yarn loops.

15. A sinker according to claim 14, wherein the support edge is formed by a recess in the front face.

* * * * *